US012421708B2

(12) United States Patent
Kobayashi et al.

(10) Patent No.: US 12,421,708 B2
(45) Date of Patent: Sep. 23, 2025

(54) FLUSH TOILET

(71) Applicant: TOTO LTD., Kitakyushu (JP)

(72) Inventors: Shoko Kobayashi, Kitakyushu (JP); Makoto Bekki, Kitakyushu (JP); Daiki Okabe, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 288 days.

(21) Appl. No.: 18/174,261

(22) Filed: Feb. 24, 2023

(65) Prior Publication Data

US 2023/0272607 A1 Aug. 31, 2023

(30) Foreign Application Priority Data

Feb. 28, 2022 (JP) ..... 2022-029681
Feb. 28, 2022 (JP) ..... 2022-029682
Feb. 28, 2022 (JP) ..... 2022-029685

(51) Int. Cl.
*E03D 11/08* (2006.01)

(52) U.S. Cl.
CPC ..... *E03D 11/08* (2013.01)

(58) Field of Classification Search
CPC ..... E03D 11/02; E03D 11/08; E03D 11/13
USPC ..... 4/420, 421
See application file for complete search history.

(56) References Cited

U.S. PATENT DOCUMENTS 10,294,644 B2 5/2019 Saeki et al.
10,724,222 B2 7/2020 Shiohara et al.
2014/0289947 A1 10/2014 Hirakawa et al.
2016/0222641 A1 8/2016 Urata et al.
2017/0247870 A1 8/2017 Saeki et al.
2018/0080208 A1 3/2018 Hashimoto et al.
2018/0195262 A1 7/2018 Hashimoto et al.
(Continued)

FOREIGN PATENT DOCUMENTS

CN 107109832 A 8/2017
CN 110306636 A 10/2019
(Continued)

OTHER PUBLICATIONS

Notice of Dispatch of Duplicates of Written Opposition mailed by the Japanese Patent Office on Aug. 7, 2024, in Japanese Patent Application No. 2022-029682; includes a list of the references as evidence on pp. 18, 225, and 226, and D1-D10 on pp. 73-224 of the whole submitted document.
(Continued)

*Primary Examiner* — Tuan N Nguyen
(74) *Attorney, Agent, or Firm* — Studebaker Brackett PLLC

(57) ABSTRACT

A flush toilet of the present invention includes a bowl including a waste receiving surface that receives waste, a rim formed on an upper part of the waste receiving surface and a well portion that is formed below the waste receiving surface and in which a pooled water surface is formed, one or more spouting ports that spout flush water along the rim, and a discharge conduit connected to a bottom portion of the bowl, the flush toilet including a configuration where a forward main flow and a rearward main flow of flush water spouted from the spouting ports circulate around a waste receiving surface of a bowl and flow, in the beginning of flushing start, into three or more regions of the pooled water surface divided into four regions.

10 Claims, 15 Drawing Sheets

(56) References Cited

U.S. PATENT DOCUMENTS

| | | | | |
|---|---|---|---|---|
| 2019/0112799 | A1 | 4/2019 | Ina et al. | |
| 2019/0301151 | A1 | 10/2019 | Shiohara et al. | |
| 2019/0330833 | A1 | 10/2019 | Maruyama et al. | |
| 2020/0095756 | A1 | 3/2020 | Shiohara et al. | |
| 2021/0095453 | A1 | 4/2021 | Nakamura et al. | |
| 2023/0272608 | A1* | 8/2023 | Kobayashi | E03D 11/08 4/420 |

FOREIGN PATENT DOCUMENTS

| | | | | |
|---|---|---|---|---|
| EP | 3321438 | A1 | 5/2018 | |
| JP | 2014-114633 | A | 6/2014 | |
| JP | 2015-067955 | A | 4/2015 | |
| JP | 2015-068126 | A | 4/2015 | |
| JP | 2015-196960 | A | 11/2015 | |
| JP | 2016-142100 | A | 8/2016 | |
| JP | 2017-020212 | A | 1/2017 | |
| JP | 2017-053177 | A | 3/2017 | |
| JP | 2017-166315 | A | 9/2017 | |
| JP | 2017-179958 | A | 10/2017 | |
| JP | 2018-044401 | A | 3/2018 | |
| JP | 2018-112004 | A | 7/2018 | |
| JP | 2019-190217 | A | 10/2019 | |
| JP | 2020-007908 | A | 1/2020 | |
| JP | 2020-051048 | A | 4/2020 | |
| JP | 2020-051052 | A | 4/2020 | |
| JP | 2020-165172 | A | 10/2020 | |
| JP | 2021-038635 | A | 3/2021 | |
| JP | 2021-055437 | A | 4/2021 | |
| JP | 2021-116541 | A | 8/2021 | |
| JP | 2023-102352 | A | 7/2023 | |
| WO | WO-2014027499 | A1 * | 2/2014 | E03D 11/08 |
| WO | WO-2018123271 | A1 * | 7/2018 | E03D 11/02 |

OTHER PUBLICATIONS

An Office Action mailed by the Japanese Patent Office on Jun. 29, 2023, which corresponds to Japanese Patent Application No. 2022-029681 and is related to U.S. Appl. No. 18/174,261.

An Office Action mailed by the Japanese Patent Office on Jul. 3, 2023, which corresponds to Japanese Patent Application No. 2022-029682 and is related to U.S. Appl. No. 18/174,261.

An Office Action mailed by the Japanese Patent Office on Jul. 3, 2023, which corresponds to Japanese Patent Application No. 2022-029685 and is related to U.S. Appl. No. 18/174,261.

An Office Action mailed by China National Intellectual Property Administration on Jun. 13, 2025, which corresponds to Chinese Patent Application No. 202310186392.4 and is related to U.S. Appl. No. 18/174,261; with English language translation.

* cited by examiner

FLUSH TOILET

BACKGROUND OF THE INVENTION

Field of the Invention

The present invention relates to a flush toilet, particularly to a flush toilet that improves a floating waste discharge power.

Description of the Related Art

Conventionally for example, as described in Japanese Patent Laid-Open No. 2017-179958, Japanese Patent Laid-Open No. 2021-55437, and Japanese Patent Laid-Open No. 2019-190217, a wash-out flush toilet that pushes away waste by flow of water due to drop of water in a bowl is known as an example of a flush toilet.

The wash-out flush toilet described in Japanese Patent Laid-Open No. 2017-179958 forms a strong flow in a specific region (corresponding to a second region S2 described later) on a pooled water surface by spouting flush water from three spouting ports and adjusting an amount of flush water spouted from the respective spouting ports, so that a favorable bowl flushing capacity can be obtained.

The wash-out flush toilet described in Japanese Patent Laid-Open No. 2021-55437 improves a waste discharge performance by spouting flush water from two spouting ports and allowing a main flow of flush water having a large circulating force to flow into a first region of a pooled water surface (corresponding to a first region S1 and a second region S2 described later).

The wash-out flush toilet described in Japanese Patent Laid-Open No. 2021-55437 improves a waste discharge capacity by allowing a large amount of flush water to flow from the rear of a pooled water surface through a second spouting port.

However, in a wash-out flush toilet, it is conceivable that a pooled water surface is made larger than before in order to reduce the area of a waste receiving surface that is a drying surface and suppress the adhesion of waste.

However, in the wash-out flush toilet in each of Japanese Patent Laid-Open No. 2017-179958, Japanese Patent Laid-Open No. 2021-55437, and Japanese Patent Laid-Open No. 2019-190217 described above, strong flush water flows into a specific region on the pooled water surface, and hence when the pooled water surface is made lager, strong flush water flows only into the specific region on the pooled water surface. Therefore, it has been found that there is a possibility that the pooled water surface is disturbed and that floating waste floating on the pooled water surface cannot be sufficiently discharged.

The present inventors have found problems caused by forming a large pooled water surface in the flush toilet such as the wash-out flush toilet and have made the present invention by an earnest study to solve the problems.

It is an object of the present invention, which has been made to solve the above-described new problems, to provide a flush toilet that improves a floating waste discharge power.

SUMMARY OF THE INVENTION

In order to achieve the above-described object, the present invention provides a flush toilet that is flushed with flush water to discharge waste, the flush toilet including: a bowl including a waste receiving surface that receives waste, a rim formed on an upper part of the waste receiving surface and a well portion that is formed below the waste receiving surface and in which a pooled water surface is formed; one or more spouting ports that spout flush water along the rim; and a discharge conduit connected to a bottom portion of the bowl, the flush toilet including a configuration where a main flow of flush water spouted from the spouting port circulates around the waste receiving surface of the bowl and flows, in the beginning of flushing start, into three or more regions of the pooled water surface divided into four regions by a front-rear centerline and a left-right centerline that divide the pooled water surface into two parts in a front-rear direction and a left-right direction in a planar view.

In the present invention including this configuration, the main flow of flush water spouted from the spouting port circulates around the waste receiving surface of the bowl and flows, in the beginning of flushing start, into three or more regions of the pooled water surface divided into four regions by the front-rear centerline and the left-right centerline that divide the pooled water surface into two parts in the front-rear direction and left-right centerline in the planar view. According to the present invention, since flush water flows, in the beginning of flushing start, into three or more regions of a region divided into four regions, a timing to discharge floating waste can be speeded up. Furthermore, the pooled water surface can be prevented from being disturbed by applying a pressing force to the whole pooled water surface, and hence a floating waste discharge power can be improved.

The present invention preferably includes a configuration where a predetermined energy accumulated amount of flush water flowing into the pooled water surface reaches, within one second, three or more regions of the pooled water surface divided into four regions.

In the present invention including this configuration, since the predetermined energy accumulated amount of flush water flowing into the pooled water surface reaches, within one second, three or more regions of the pooled water surface divided into four regions, a pushing pressure exerted on the pooled water surface can be made constant, and floating waste can be discharged while suppressing the disturbance of the pooled water surface.

In the present invention, preferably, the main flow of flush water forms a forward main flow that circulates on a front side of the waste receiving surface of the bowl and a rearward main flow that circulates on a rear side of the waste receiving surface of the bowl.

In the present invention including this configuration, a floating waste discharge performance can be improved while flushing the whole waste receiving surface of the bowl by forming the forward main flow and the rearward main flow of flush water.

The present invention preferably includes a configuration where the forward main flow and the rearward main flow of flush water flow into the pooled water surface without joining each other.

In the present invention including this configuration, since the forward main flow and the rearward main flow of flush water flow into the pooled water surface without joining each other, the energy of the flush water flowing into three or more regions is easily made constant, and floating waste can be discharged while suppressing the disturbance of the pooled water surface.

The present invention preferably includes a configuration where the forward main flow and the rearward main flow of flush water flow into different regions of a region divided into four regions, respectively.

In the present invention including this configuration, the forward main flow and the rearward main flow of flush water flow into different regions of a boundary divided into four regions, respectively, that is, the flows are prevented from flowing into the same region. Therefore, the pushing pressure onto the pooled water surface can be easily made constant, and the disturbance of the pooled water surface can be easily suppressed.

The present invention preferably includes a configuration where the spouting port includes a first spouting port that forms a forward main flow and a second spouting port that forms a rearward main flow, the first spouting port is formed on one of left and right sides of a front region of the waste receiving surface of a bowl surface, the second spouting port is formed on the other of the left and right sides of a rear region of the waste receiving surface of the bowl surface, the forward main flow mainly flows into the rear region on one of the left and right sides on which the first spouting port is not provided in the pooled water surface divided into four regions, and the rearward main flow mainly flows into the front region on one of the left and right sides on which the second spouting port is not provided in the pooled water surface divided into four regions.

In the present invention including this configuration, since the flush water spouted from each of the first spouting port and the second spouting port flows into the region on the side where the spouting port is not provided, the flush water flows into the pooled water surface without circulating once around the bowl surface, and a timing for flush water to flow into the pooled water surface can be speeded up.

In the present invention, preferably, a rear surface of the waste receiving surface of the bowl includes a concave portion recessed deeper than left and right side surfaces of the waste receiving surface, and the rear surface extends to below an upper end of left and right side surfaces of the well portion.

In the present invention including this configuration, the rear surface of the waste receiving surface of the bowl includes the concave portion recessed deeper than the left and right side surfaces of the waste receiving surface, and the rear surface extends to below the upper end of the left and right side surfaces of the well portion. Therefore, the forward main flow of flush water passes through the side surface of the well portion to reach the rear surface of the waste receiving surface and changes a flow direction on the rear surface and flows as it is along the rear surface of the waste receiving surface into the pooled water surface. As a result, according to the present invention, the forward main flow of flush water can be guided to the pooled water surface earlier than a flow circulating around the waste receiving surface and flowing into the pooled water surface, and hence the forward main flow and the rearward main flow can be guided to the pooled water surface at about the same timing. This can improve the floating waste discharge performance.

In the present invention, preferably, the concave portion on the rear surface of the waste receiving surface of the bowl is formed so that a lateral width of the concave portion is smaller than a maximum lateral width of the well portion.

In the present invention including this configuration, since the concave portion on the rear surface of the waste receiving surface of the bowl is formed so that a lateral width W2 of the concave portion is smaller than a maximum lateral width W1 of the well portion, the flush water circulating around the side surface of the well portion from the front can be inhibited from spreading, and the inflow of the forward main flow of flush water into the pooled water surface can be speeded up.

In the present invention, preferably, the concave portion on a rear surface of the waste receiving surface of the bowl is formed in a concave shape along an up-down direction and has a lower end connected to a rear surface of the well portion by a convex-shaped connecting portion.

In the present invention including this configuration, the concave portion on the rear surface of the waste receiving surface of the bowl is formed in the concave shape along the up-down direction and has the lower end connected to the rear surface of the well portion by the convex-shaped connecting portion, and hence flush water can be smoothly guided to the pooled water surface.

In the present invention, preferably, the well portion is formed so that, in a curvature radius R1 at an upper position of a rear surface of the well portion and a curvature radius R2 at a lower position, the curvature radius R2 at the lower position is smaller than the curvature radius R1 at the upper position.

In the present invention including this configuration, the well portion is formed so that, in the curvature radius R1 at the upper position of the rear surface of the well portion and the curvature radius R2 at the lower position, the curvature radius R2 at the lower position is smaller than the curvature radius R1 at the upper position (R1>R2), which smoothens the flow of flush water flowing outward from the well portion to the discharge conduit, and improves a waste discharge performance.

In the present invention, preferably, the spouting port includes a first rim spouting port and a second rim spouting port, the first rim spouting port is disposed in front of a front end of the pooled water surface in an inner space of the bowl, and flush water is spouted forward from the first rim spouting port, and the second rim spouting port is disposed behind a rear end of the pooled water surface, and flush water is spouted rearward from the second rim spouting port.

In the present invention including this configuration, the first rim spouting port is disposed in front of the front end of the pooled water surface, and flush water is spouted forward from the first rim spouting port, and the second rim spouting port is disposed behind the rear end of the pooled water surface, and flush water is spouted rearward from the second rim spouting port. Consequently, at the start of flushing, flush water from the first rim spouting port and the second rim spouting port is allowed to flow into pooled water early and almost simultaneously, and the flush water can be evenly poured into the whole pooled water surface. Therefore, in the flush toilet in which all the flush water supplied to a toilet main body is spouted from the rim spouting port, floating waste can be sufficiently discharged.

In the present invention, preferably, the first rim spouting port and the second rim spouting port are arranged on the left side of a left end of the pooled water surface or on the right side of a right end of the pooled water surface.

In the present invention including this configuration, at the start of flushing, the flush water from the first rim spouting port and the second rim spouting port flow into the pooled water more simultaneously, and the flush water can be evenly poured into the whole pooled water surface.

In the present invention, preferably the first rim spouting port and the second rim spouting port, in a planar view, are arranged in regions, respectively, that are diagonal so as to sandwich an intersection point at which a centerline that divides the pooled water surface into two equal parts in a left-right direction and a centerline that divides the pooled water surface into two equal parts in a front-rear direction intersect.

In the present invention including this configuration, at the start of flushing, the flush water from the first rim spouting port and the second rim spouting port flows into the pooled water more simultaneously, and the flush water can be evenly poured into the whole pooled water surface.

DETAILED DESCRIPTION OF THE PREFERRED EMBODIMENTS

Hereinafter, a flush toilet according to a first embodiment of the present invention will be described. The flush toilet according to the embodiment of the present invention is applicable to a wash-out flush toilet, a siphon flush toilet or another form of flush toilet. Hereinbelow, the wash-out flush toilet will be first described as the embodiment of the present invention with reference to FIGS. 1 and 2.

Figure 1:
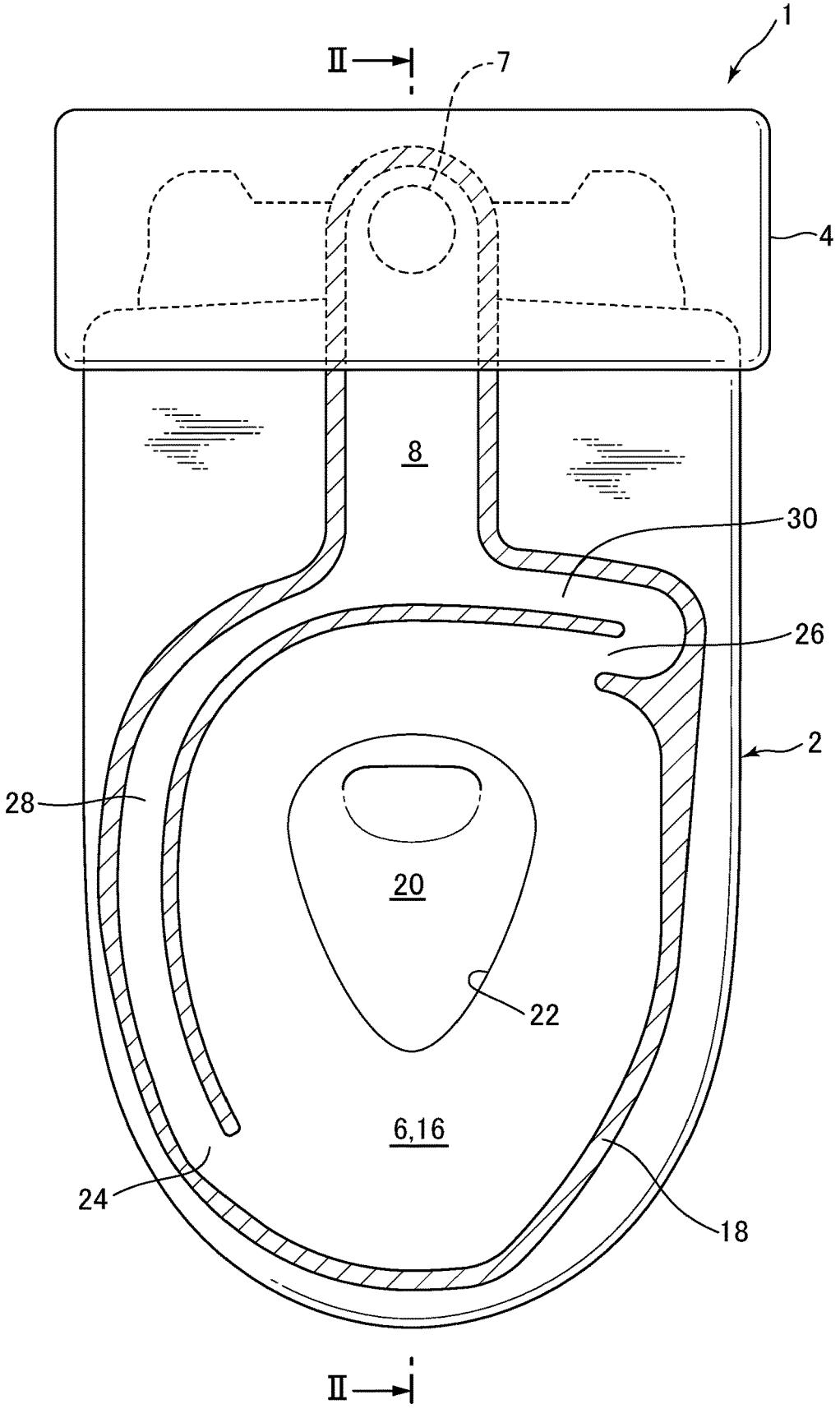
FIG. 1 is a is a planar cross-sectional view of a flush toilet according to a first embodiment of the present invention.
Figure 2:
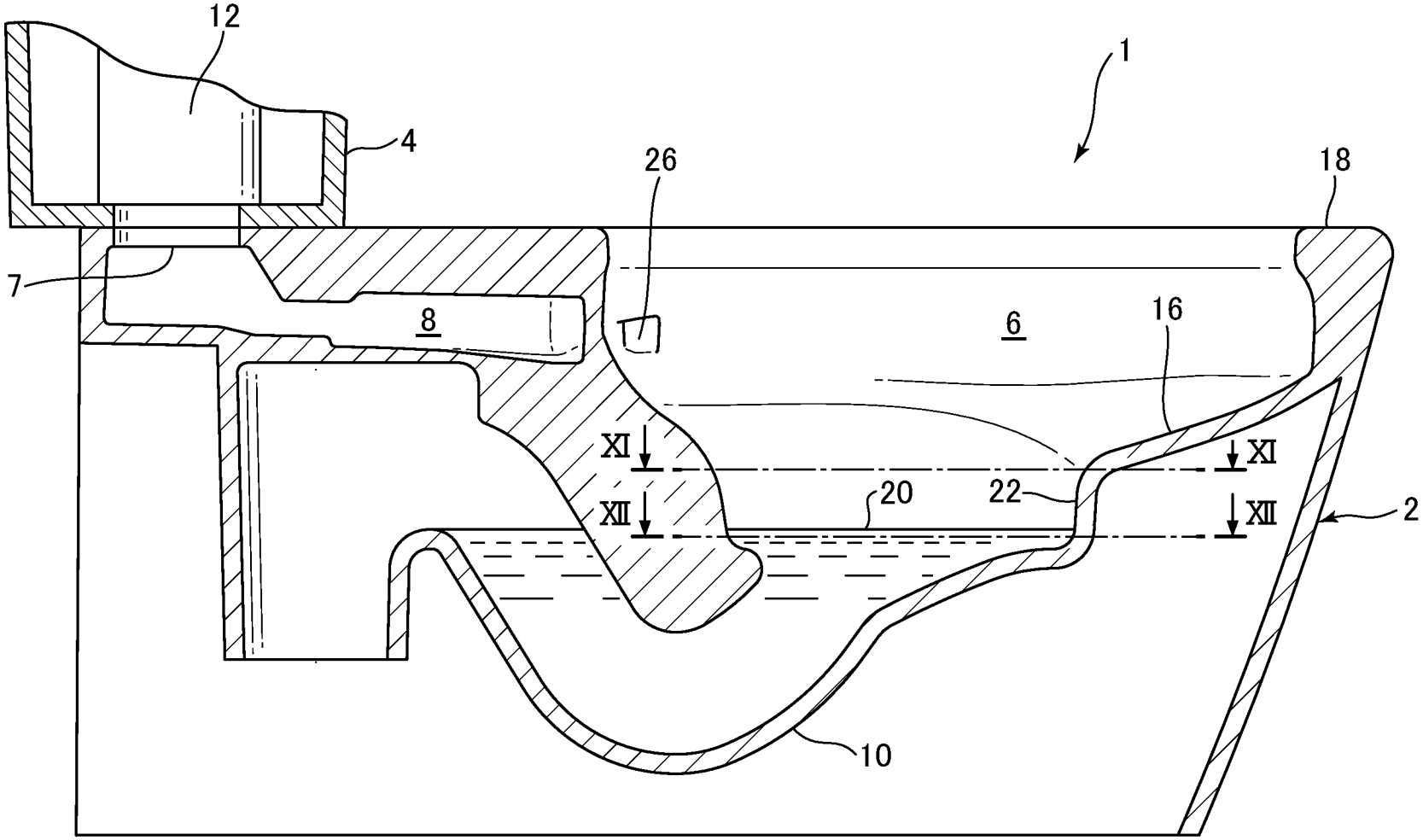
FIG. 2 is a longitudinal cross-sectional view seen along the II-II line of FIG. 1.

As shown in FIGS. 1 and 2, a flush toilet 1 is a wash-out toilet that pushes away waste by flow of water due to drop of water in a bowl. The flush toilet 1 includes a toilet main body 2 made of pottery, and a storage tank 4 that stores flush water to flush the toilet main body 2. The toilet main body 2 includes a bowl 6 on a front side, and a common water passageway 8 including an opening 7 provided at an upstream end and communicating with the storage tank 4 is formed in an upper rear part of the toilet main body. Further, a discharge conduit 10 for discharging waste is formed in a lower rear part of the bowl 6.

Here, in the present description, when seen from a user, a proximal side in the flush toilet is described as a front side, a distal side is described as a rear side, a right side is described as the right side, and a left side is described as the left side.

The storage tank 4 described above includes a discharge valve 12. When the user operates and opens an operation lever (not shown), the discharge valve 12 opens, and flush water in the storage tank 4 is supplied to the toilet main body 2.

Additionally, in the present embodiment, in addition to the storage tank 4, as a water source of flush water, a tap water direct pressure type may be used, or for the water source, a flush valve may be used. Alternatively, flush water may be supplied using a pump.

The bowl 6 includes a bowl-shaped waste receiving surface 16, a rim 18 formed above the waste receiving surface 16, and a well portion 22 that is formed below the waste receiving surface 16 in which a pooled water surface 20 is formed. Here, the pooled water surface 20 of the well portion 22 is substantially triangular, has a size of 160 mm to 180 mm in a front-rear direction in a top view and a size of 125 mm to 145 mm in a width direction and is formed larger (enlarged) than a pooled water surface of a conventional wash-out flush toilet. Also, the well portion 22 forms a substantially triangular shape closer to an oval shape (elliptic shape with a tapered front side) than the pooled water surface 20 and has a size of 20 cm to 24 cm in the front-rear direction in the top view and a size of 15 cm to 19 cm in a lateral direction.

In the rim 18 of the bowl 6, a first spouting port 24 to spout flush water is formed on the front side on the left side seen from front, and a second spouting port 26 to spout flush water is further formed on the rear side on the right side seen from the front. The common water passageway 8 described above extends to a downstream side and branches to a first water passageway 28 and a second water passageway 30. The first water passageway 28 extends to the first spouting port 24, and the second water passageway 30 extends to the second spouting port 26, to supply flush water from the storage tank 4 to the first spouting port 24 and the second spouting port 26. Here, the first spouting port 24 and the second spouting port 26 spout flush water in an orientation to form a circulating flow that circulates in the same direction. In the present embodiment, a counterclockwise circulating flow is formed.

Alternatively, in the present embodiment, one spouting port may be formed, or two or more (for example, three) spouting ports may be formed.

Figure 3:
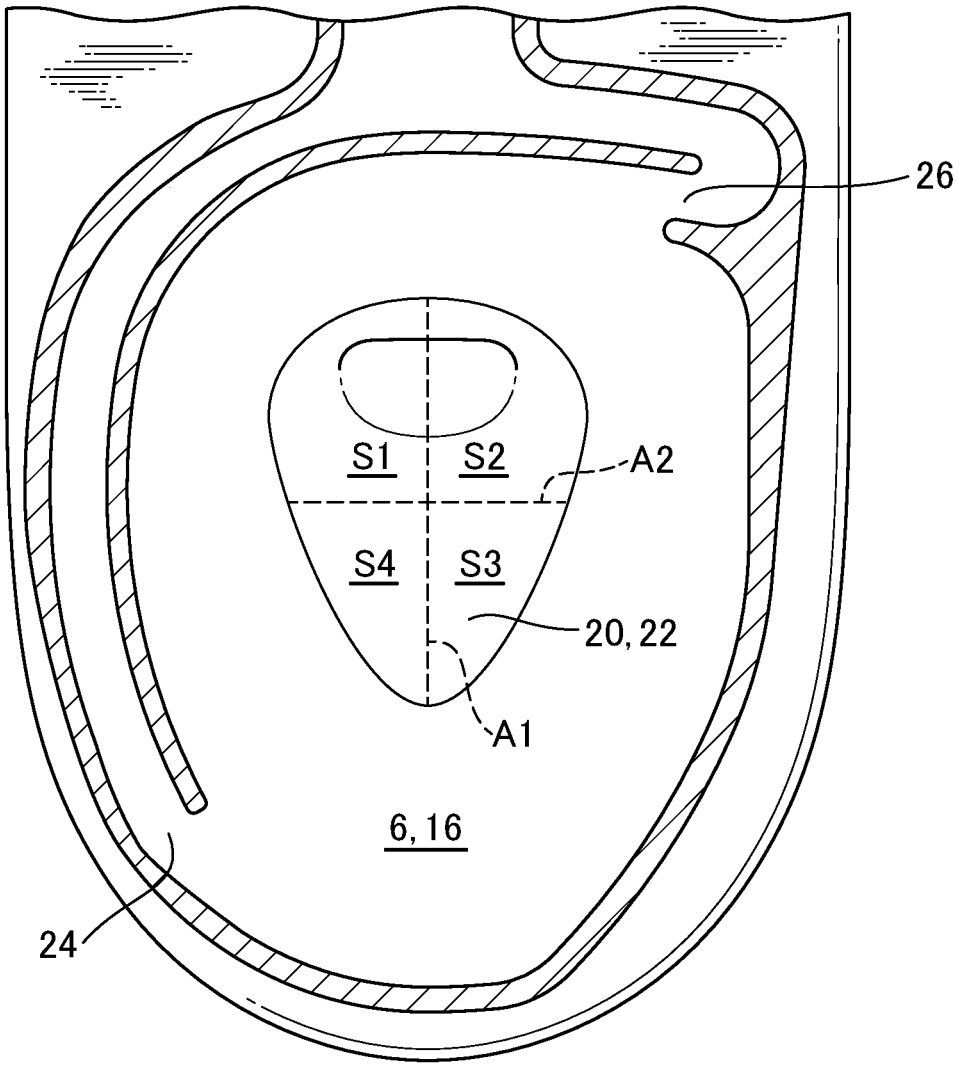
FIG. 3 is a plan view showing a first region S1, a second region S2, a third region S3, and a fourth region S4 of a flowing water surface in the flush toilet according to the first embodiment of the present invention.

Next, the pooled water surface in the flush toilet according to the first embodiment of the present invention will be described with reference to FIG. 3. As shown in FIG. 3, for the convenience of explanation, a region of the pooled water surface 20 formed inside the well portion 22 is divided into four regions by a left-right (width direction) centerline A1 extending in the front-rear direction, and a front-rear centerline A2 extending in the width direction, and these four regions will be described. Specifically, the pooled water surface 20 includes a left rear side first region S1, a right rear side second region S2, a right front side third region S3, and a left front side fourth region S4. In the present embodiment, the pooled water surface 20 is divided into four regions, and the well portion 22 may be similarly divided into four regions.

Figure 4A:
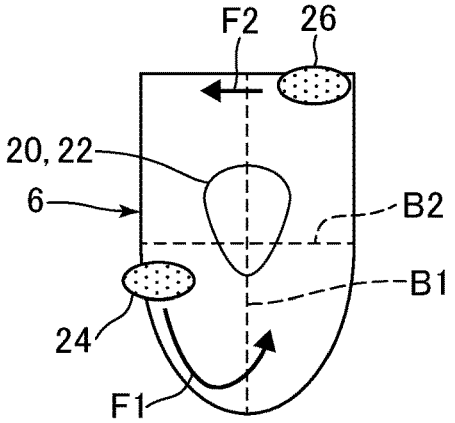
FIG. 4A is a schematic plan view of a first example showing arrangement, in a bowl, of a first spouting port and a second spouting port in the flush toilet according to the first embodiment of the present invention.
Figure 4B:
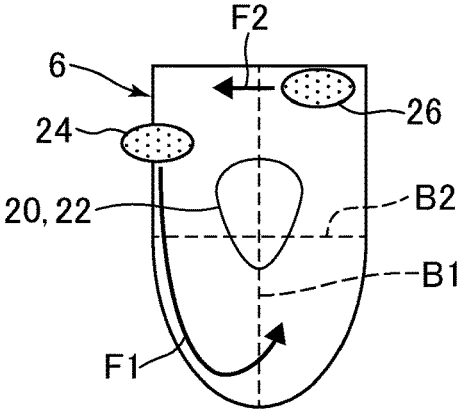
FIG. 4B is a schematic plan view of a second example showing arrangement, in the bowl, of the first spouting port and the second spouting port in the flush toilet according to the first embodiment of the present invention.
Figure 4C:
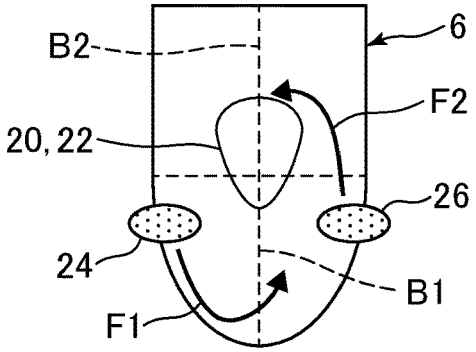
FIG. 4C is a schematic plan view of a third example showing arrangement, in the bowl, of the first spouting port and the second spouting port in the flush toilet according to the first embodiment of the present invention.
Figure 4D:
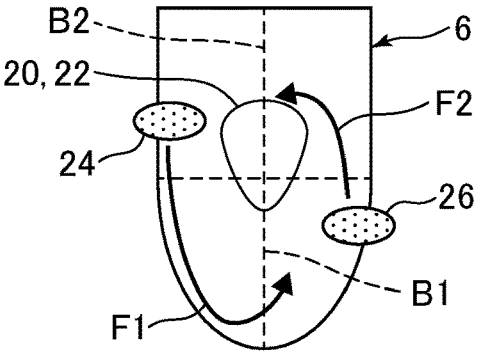
FIG. 4D is a schematic plan view of a fourth example showing arrangement, in the bowl, of the first spouting port and the second spouting port in the flush toilet according to the first embodiment of the present invention.

Next, various arrangements of spouting ports to spout flush water will be described with reference to FIGS. 4A, 4B, 4C and 4D. FIG. 4A is a schematic plan view of a first example showing arrangement, in the bowl, of the first and second spouting ports in the flush toilet according to the first embodiment of the present invention, FIG. 4B is a schematic plan view of a second example showing the arrangement, in the bowl, of the first and second spouting ports in the flush toilet according to the first embodiment of the present invention. FIG. 4C is a schematic plan view of a third example showing the arrangement, in the bowl, of the first and second spouting ports in the flush toilet according to the first embodiment of the present invention, and FIG. 4D is a schematic plan view of a fourth example showing the arrangement, in the bowl, of the first and second spouting ports in the flush toilet according to the first embodiment of the present invention.

As shown in FIGS. 4A to 4D, the bowl 6, in a top view, is divided into four regions by a left-right (width direction) centerline B1 extending in the front-rear direction and a front-rear centerline B2 extending in the width direction.

In the first example shown in FIG. 4A, the first spouting port 24 is disposed in a front left region of the bowl 6 and spouts water forward to form a forward main flow F1, and the second spouting port 26 is disposed in a rear right region of the bowl 6 and spouts water in the lateral direction to form a rearward main flow F2.

In the second example shown in FIG. 4B, the first spouting port 24 is disposed in a rear left region of the bowl 6 and spouts water forward to form the forward main flow F1, and the second spouting port 26 is disposed in a rear right region of the bowl 6 and spouts water in the lateral direction to form the rearward main flow F2.

In the third example shown in FIG. 4C, the first spouting port 24 is disposed in the front left region of the bowl 6 and spouts water forward to form the forward main flow F1, and the second spouting port 26 is disposed in a front right region of the bowl 6 and spouts water rearward to form the rearward main flow F2.

In the fourth example shown in FIG. 4D, the first spouting port 24 is disposed in the rear left region of the bowl 6 and spouts water forward to form the forward main flow F1, and the second spouting port 26 is disposed in the front right region of the bowl 6 and spouts water rearward to form the rearward main flow F2.

According to the flush toilet 1 of the present embodiment, in the first example of FIG. 4A, both the forward main flow F1 and the rearward main flow F2 are easy to flow into the pooled water surface 20, but in the second example of FIG. 4B, the forward main flow F1 is difficult to flow into the pooled water surface 20, and in the third example of FIG. 4C, the rearward main flow F2 is difficult to flow into the pooled water surface 20, and in the fourth example of FIG. 4D, both the forward main flow F1 and the rearward main flow F2 are difficult to flow into the pooled water surface 20.

In the flush toilet 1 of the present embodiment, main flows of flush water, that is, the forward main flow F1 and the rearward main flow F2 flow, in the beginning of flushing start, into three or more of the four regions of the pooled water surface 20 described above, to speed up a floating waste discharge timing. Furthermore, the pooled water surface 20 can be prevented from being disturbed by applying a pressing force to a front surface of the pooled water surface 20, and hence a floating waste discharge power can be improved.

In the flush toilet 1 according to the present embodiment, the following means are adopted in order to achieve the above-described characteristics.

Means 1 (when the First Spouting Port and the Second Spouting Port are Provided)

First, as in the first example of FIG. 4A and the third example of FIG. 4C, when the inflow of the forward main flow F1 of the flush water spouted from the first spouting port 24 into the pooled water surface 20 is fast, (i) inflow delay means is provided for slowing the inflow of the forward main flow F1 of the flush water spouted from the first spouting port 24 into the pooled water surface 20. The inflow delay means may include controlling a flow velocity of flush water with a pressurizing pump or controlling the flow velocity by a shape of the first water passageway 28 of flush water, a shape of the first spouting port 24, a shape of the waste receiving surface 16, or the like. Alternatively, a distance of the forward main flow F1 spouted from the first spouting port 24 to the pooled water surface 20 may be increased.

Furthermore, when the inflow of the forward main flow F1 of the flush water spouted from the first spouting port 24 into the pooled water surface 20 is fast, (ii) inflow promoting means is provided for speeding up the inflow of the forward main flow F1 of the flush water spouted from the second spouting port 26 into the pooled water surface 20. The inflow promoting means may allow the rearward main flow F2 spouted from the second spouting port 26 to flow toward the pooled water surface 20, or may increase the flow velocity of the rearward main flow F2. For this purpose, the flow velocity of the flush water may be controlled with the pressurizing pump, or the flow velocity may be controlled by a shape of the second water passageway 30 of flush water, a shape of the second spouting port 26, the shape of the waste receiving surface 16, or the like.

Means 2 (when the First Spouting Port and the Second Spouting Port are Provided)

Next, as in the second example of FIG. 4B and the fourth example of FIG. 4D, when the inflow of the forward main flow F1 of the flush water spouted from the first spouting port 24 into the pooled water surface 20 is slow, inflow promoting means is provided for speeding up the inflow of the forward main flow F1 of the flush water spouted from the first spouting port 24 into the pooled water surface 20. The inflow promoting means may include controlling the flow velocity of flush water with the pressurizing pump, or controlling the flow velocity by the shape of the first water passageway 28 of flush water, the shape of the first spouting port 24, the shape of the waste receiving surface 16 or the like. Alternatively, the distance of the forward main flow F1 spouted from the first spouting port 24 to the pooled water surface 20 may be decreased, or the forward main flow F1 may flow along the side surface of the well portion 22 into the pooled water surface 20.

Means 3 (when the First Spouting Port and the Second Spouting Port are Provided)

Further, as in the second example of FIG. 4B and the fourth example of FIG. 4D, when the inflow of the forward main flow F1 of the flush water spouted from the first spouting port 24 into the pooled water surface 20 is slow, inflow promoting means is provided for speeding up the inflow of the rearward main flow F2 of the flush water spouted from the second spouting port 26 into the pooled water surface 20. The inflow promoting means may include controlling the flow velocity of flush water with the pressurizing pump or controlling the flow velocity by the shape of the second water passageway 30 of flush water, the shape of the second spouting port 26, the shape of the waste receiving surface 16 or the like. Alternatively, the distance of the rearward main flow F2 spouted from the second spouting port 26 to the pooled water surface 20 may be increased.

Next, with reference to FIGS. 5, 6A and 6B, kinetic energy when the flush water flows into the pooled water surface in the flush toilet 1 according to the present embodiment will be described. Here, the kinetic energy of flush water shown in FIGS. 5, 6A and 6B is measured using fluid analysis, and FIGS. 5, 6A and 6B show the measurement results.

First, when the user operates and opens the operation lever (not shown) of the storage tank 4, the discharge valve 12 opens, and the flush water stored in the storage tank 4 is spouted from the first spouting port 24 and the second spouting port 26 through the common water passageway 8, the first water passageway 28 and the second water passageway 30.

Figure 5:
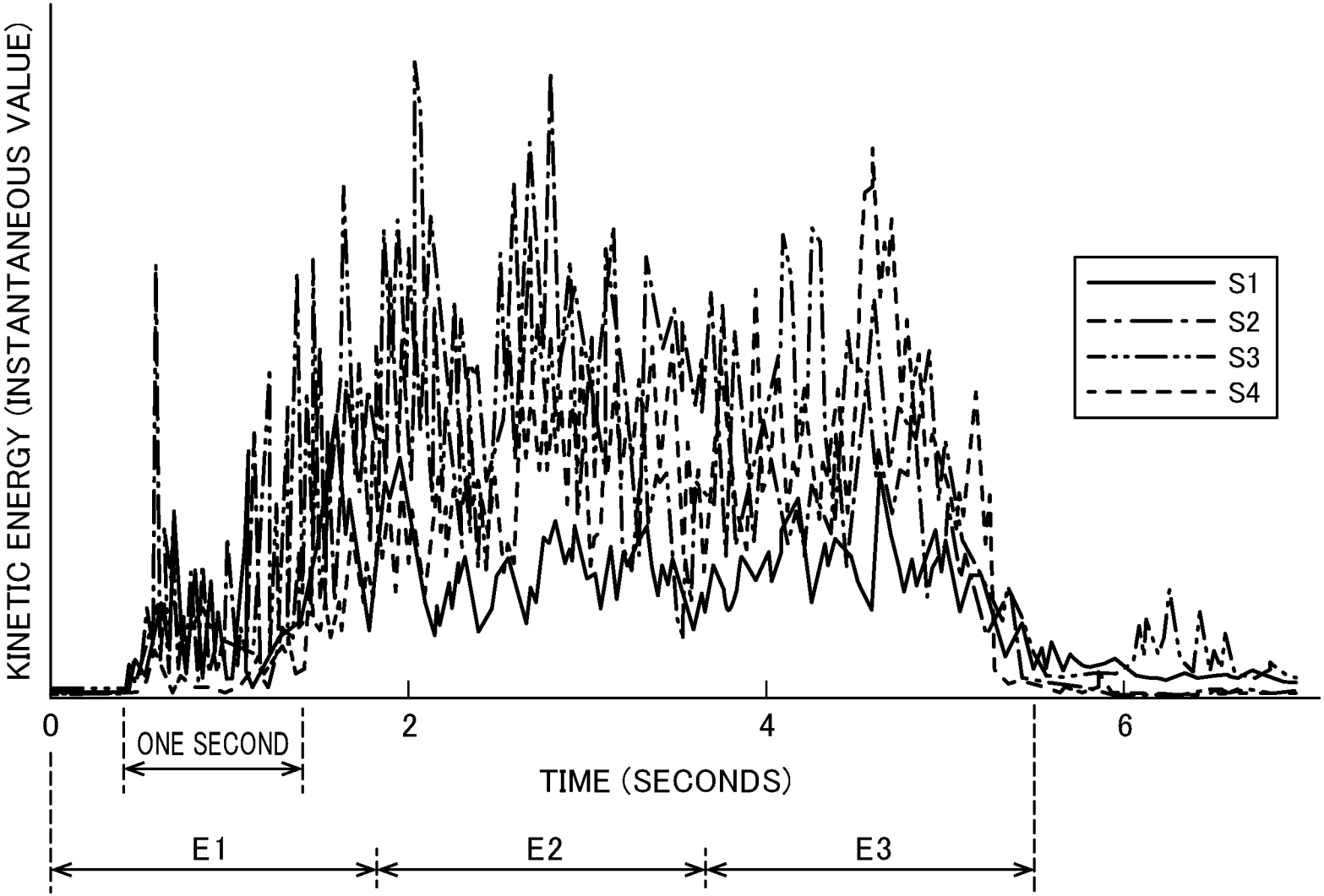
FIG. 5 is a diagram showing kinetic energy (instantaneous value) when flush water spouted from the spouting port flows into each region of a pooled water surface according to the flush toilet of the first embodiment of the present invention.

Here, as shown in FIG. 5, it takes about 5.5 seconds to operate and open the operation lever, start spouting water, allow flush water to flow into the pooled water surface 20 and end this inflow. This inflow period is divided into an initial flushing period E1 in the beginning of flushing start, a middle flushing period E2 and a late flushing period E3. As can be seen from FIG. 5, for the kinetic energy of the flush water flowing into each region (S1, S2, S3, S4) of the pooled water surface 20, when one second elapses after the flush water flows into the pooled water surface 20, a substantial amount of kinetic energy is generated.

Figure 6A:
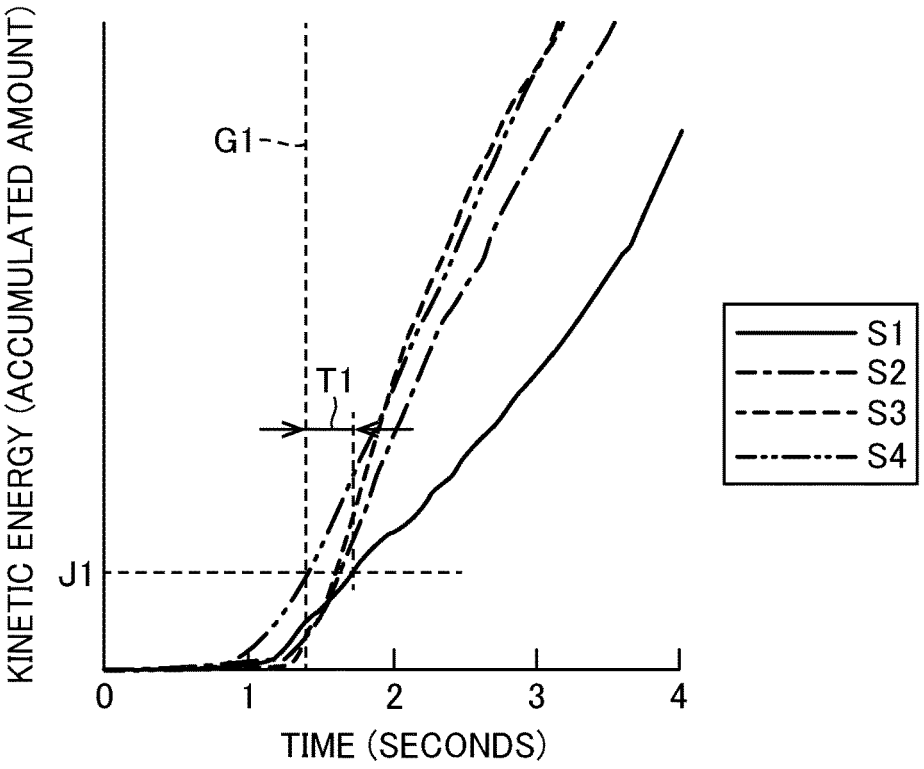
FIG. 6A is a diagram showing kinetic energy (accumulated amount) when flush water spouted from the spouting port flows into each region of the flowing water surface according to the flush toilet of the first embodiment of the present invention.
Figure 6B:
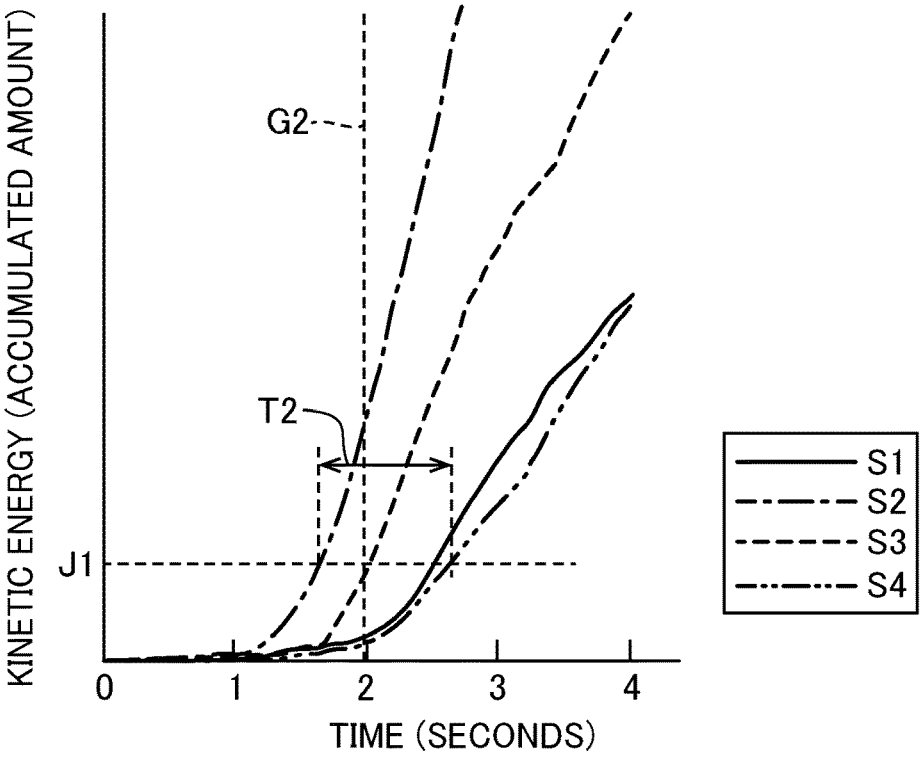
FIG. 6B is a diagram showing kinetic energy (accumulated amount) when flush water spouted from the spouting port flows into each region of the flowing water surface according to a flush toilet of a comparative example of the first embodiment of the present invention.

Next, as shown in FIG. 6A, in the flush toilet 1 according to the present embodiment, for the kinetic energy (accumulated value) of the flush water flowing into the respective regions S1, S2, S3 and S4 of the pooled water surface 20, when time G1 is reached, the kinetic energy rises (is generated) in all the regions. Further, it can be seen that the kinetic energy (accumulated value) in the four regions S1, S2, S3 and S4 reaches a predetermined value J1 within a difference of one second (that is, time T1).

On the other hand, in a comparative example of the present embodiment, for the kinetic energy (accumulated value) of the flush water flowing into the respective regions S1, S2, S3 and S4 of the pooled water surface 20, when time G2 is reached, the kinetic energy rises (is generated) in all the regions. Further, it can be seen that the kinetic energy (accumulated value) in the four regions S1, S2, S3 and S4 reaches the predetermined value J1 with a difference of one or more seconds (that is, time T2).

Figure 7:
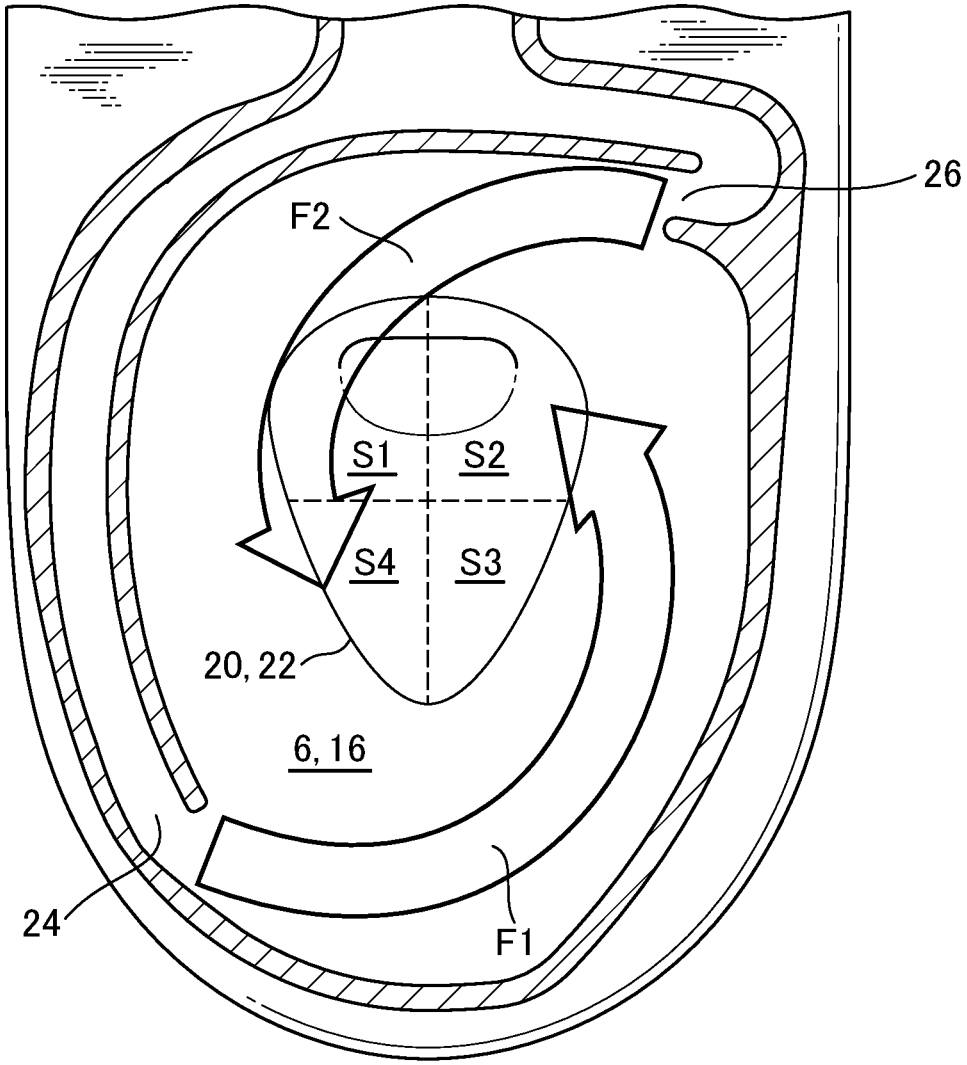
FIG. 7 is a plan view of the bowl showing a state of inflow of flush water spouted from the first spouting port and the second spouting port into the pool water surface in the flush toilet according to the first embodiment of the present invention.

Next, a state of inflow of flush water into the pooled water surface in the flush toilet 1 according to the present embodiment will be described with reference to FIG. 7. FIG. 7 is a plan view of the bowl showing the state of the inflow of the flush water spouted from the first spouting port and the second spouting port into the pooled water surface in the flush toilet according to the present embodiment.

As shown in FIG. 7, first, the forward main flow F1 of the flush water spouted from the first spouting port 24 flows through the front region on the right side of the waste receiving surface 16 of the bowl 6, then reaches the rear region of the waste receiving surface 16 and flows into (flows down to) the regions S2 and S1 of the pooled water surface 20.

Next, the rearward main flow F2 of the flush water spouted from the second spouting port 26 flows through the rear region on the left side of the waste receiving surface 16 of the bowl 6, then reaches the front region of the waste receiving surface 16 and flows into (flows down to) the regions S4 and S3 of the pooled water surface 20.

As is clear also from FIG. 7, in the flush toilet 1 of the present embodiment, the forward main flow F1 and the rearward main flow F2 of flush water flow into the pooled water surface 20 without joining each other.

Further, the forward main flow F1 and the rearward main flow F2 of flush water flow into different regions of a boundary divided into four regions S1, S2, S3 and S4, respectively.

Hereinafter, operations and effects according to the first embodiment described above will be described.

First, the flush toilet 1 according to the present embodiment includes the configuration where the forward main flow F1 and the rearward main flow F2 of the flush water spouted from the first spouting port 24 and the second spouting port 26 circulate around the waste receiving surface 16 of the bowl 6 and flow, in the beginning of flushing start, into three or more regions of the pooled water surface divided into four regions S1, S2, S3 and S4 by the front-rear centerline and the left-right centerline that divide the pooled water surface 20 into two parts in the front-rear direction and the left-right direction in a planar view. Therefore, according to the present embodiment, since flush water flows into three or more regions of the pooled water surface divided into the four regions S1, S2, S3 and S4 in the beginning of flushing start, the floating waste discharge timing can be speeded up. Furthermore, the pooled water surface 20 can be prevented from being disturbed by applying the pressing force to the whole pooled water surface 20, and hence a floating waste discharge power can be improved.

Next, in the flush toilet 1 according to the present embodiment, since the predetermined energy accumulated amount of the flush water flowing into the pooled water surface 20 reaches, within one second, three or more regions of the pooled water surface divided into the four regions S1, S2, S3 and S4, a pushing pressure exerted on the pooled water surface 20 can be made constant, and floating waste can be discharged while suppressing the disturbance of the pooled water surface 20.

Next, in the flush toilet 1 according to the present embodiment, a floating waste discharge performance can be improved while flushing the whole waste receiving surface 16 of the bowl 6 by forming the forward main flow F1 and the rearward main flow F2 of flush water.

Next, in the flush toilet 1 according to the present embodiment, since the forward main flow F1 and the rearward main flow F2 of flush water flow into the pooled water surface 20 without joining each other, the energy of the flush water flowing into three or more regions is easily made constant, and floating waste can be discharged while suppressing the disturbance of the pooled water surface 20.

Next, in the flush toilet 1 according to the present embodiment, the forward main flow F1 and the rearward main flow F2 of flush water flow into different regions of the boundary divided into the four regions S1, S2, S3 and S4, that is, the flows are prevented from flowing into the same region. Therefore, the pushing pressure onto the pooled water surface 20 can be easily made constant, and the disturbance of the pooled water surface 20 can be easily suppressed.

Next, in the flush toilet 1 according to the present embodiment, since the flush water spouted from each of the first spouting port 24 and the second spouting port 26 flows into the region on the side on which the spouting port is not provided, the flush water flows into the pooled water surface 20 without circulating once around the surface of the bowl 6, and the timing for flush water to flow into the pooled water surface 20 can be speeded up.

Next, with reference to FIGS. 2 and 8 to 14, a flush toilet 101 according to a second embodiment of the present invention will be described.

First, with reference to FIGS. 8 to 10, specific shapes and the like of a waste receiving surface 16 and a well portion 22 in the flush toilet 101 will be described.

Figure 8:
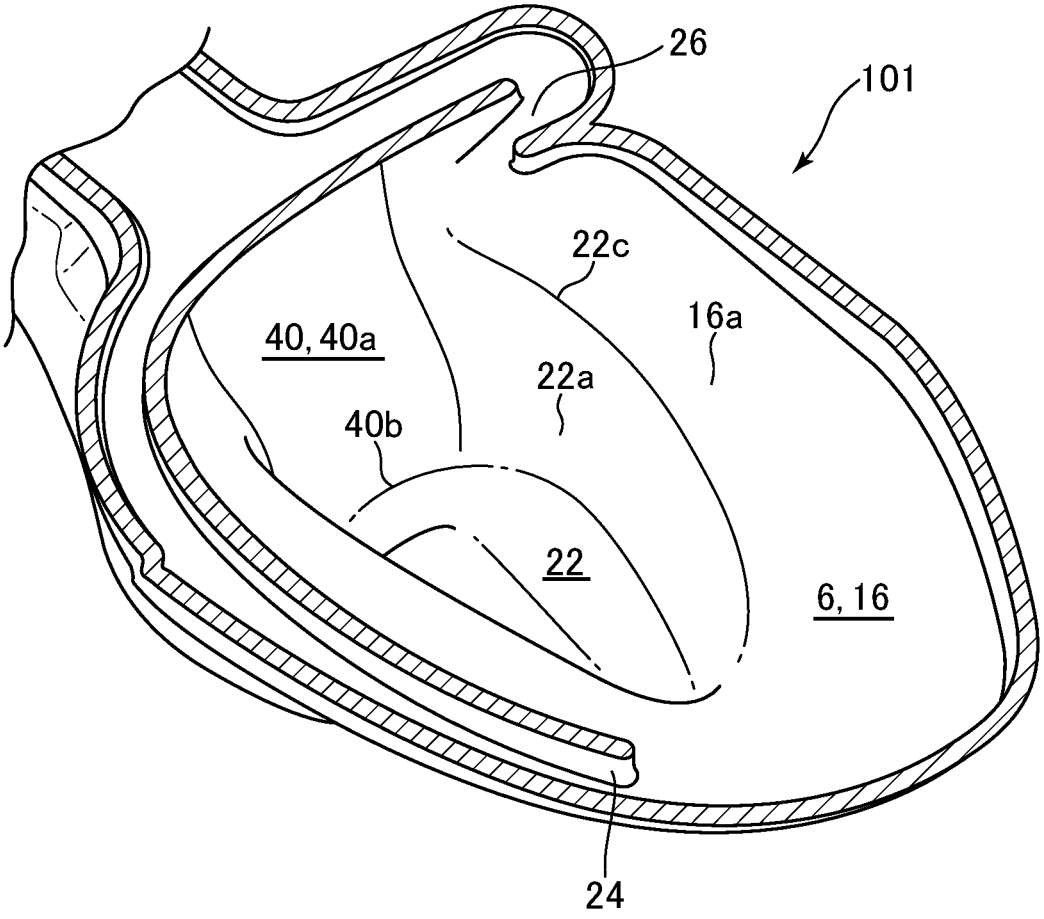
FIG. 8 is a perspective cross-sectional view of a flush toilet according to a second embodiment of the present invention seen from diagonally above.

First, as shown in FIG. 8, a rear surface 40 of the waste receiving surface 16 of the bowl 6 includes a concave portion 40*a* recessed deeper than left and right side surfaces 16*a* of the waste receiving surface 16. A lower end 40*b* of the rear surface 40 including the concave portion 40*a* extends to below an upper end 22*c* of a right side surface 22*a* and a left side surface 22*b* of the well portion 22.

Figure 9:
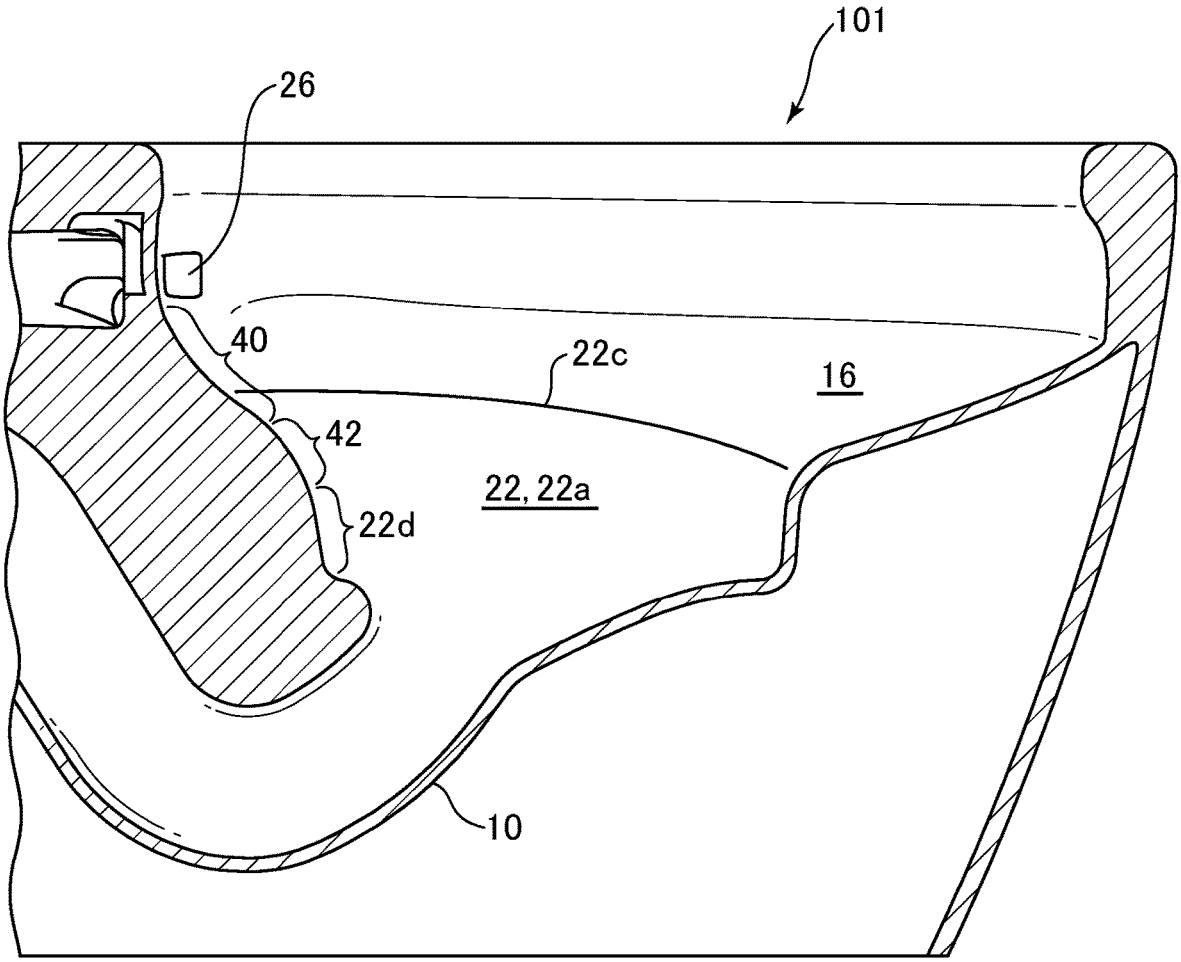
FIG. 9 is a partially enlarged longitudinal cross-sectional view of FIG. 2.

As shown in FIG. 9, the rear surface 40 of the waste receiving surface 16 of the bowl 6 is connected to a rear surface 22*d* of the well portion 22 via a connecting portion 42. Here, the rear surface 40 of the waste receiving surface 16 has a concave shape along an up-down direction, the connecting portion 42 has a convex shape, and the rear surface 40 and the connecting portion 42 are smoothly connected by an inflection point. The connecting portion 42 corresponds to the lower end 40*b* of the rear surface 40 of the waste receiving surface 16.

Figure 10:
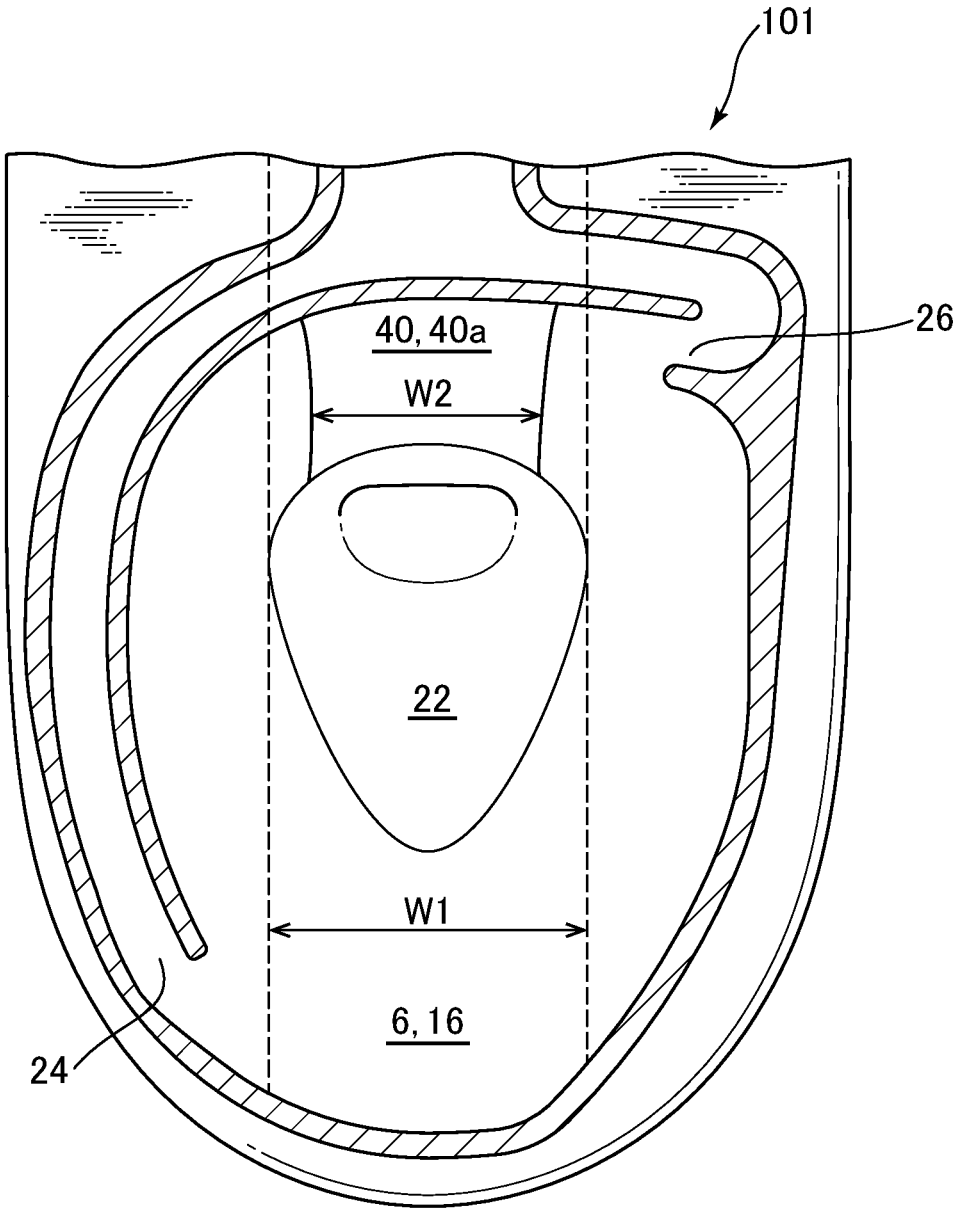
FIG. 10 is a partially enlarged planar cross-sectional view of FIG. 1.

As shown in FIG. 10, the concave portion 40*a* of the rear surface 40 of the waste receiving surface 16 of the bowl 6 is formed so that a lateral width W2 of the concave portion is smaller than a maximum lateral width W1 of the well portion 22 in a planar view.

Next, a shape of the rear surface 22*d* of the well portion 22 will be described with reference to FIGS. 2, 11 and 12.

Figure 11:
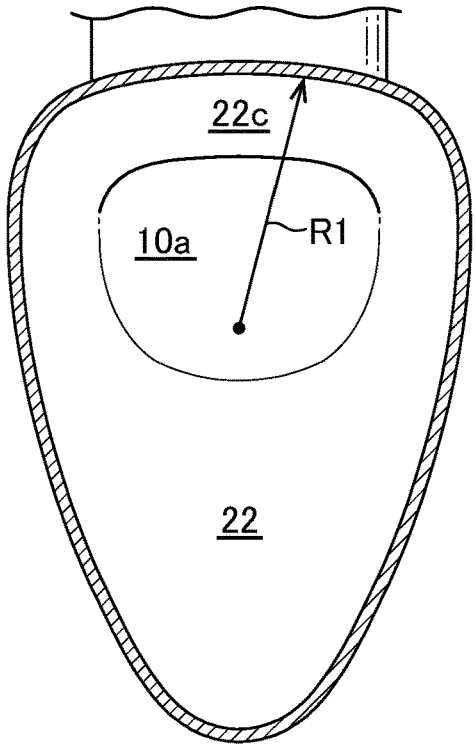
FIG. 11 is a cross-sectional view seen along the XI-XI line of FIG. 2.
Figure 12:
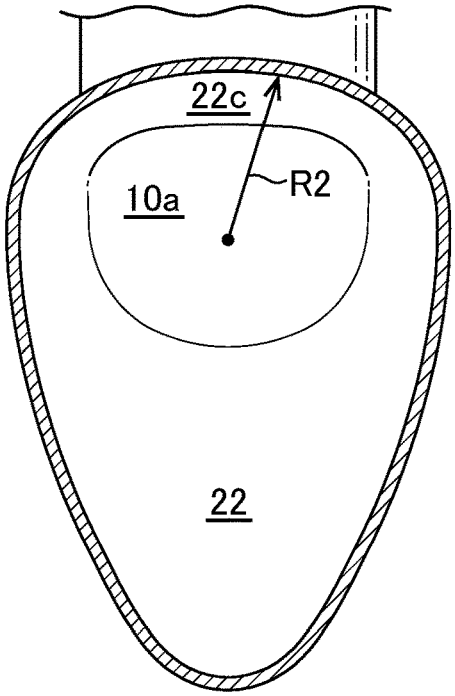
FIG. 12 is a cross-sectional view seen along the XII-XII line of FIG. 2.

As shown in FIG. 11, an upper position of the rear surface 22*d* of the well portion 22 is formed by a curvature radius R1, and as shown in FIG. 12, a lower position of the rear surface 22*d* of the well portion 22 is formed by a curvature radius R2. Here, the curvature radius R2 has a value smaller than the curvature radius R1 (R1>R2). For this reason, as shown in FIG. 8, the curvature radius R2 at the lower position of the rear surface 22*d* of the well portion 22 has a value close to a value of a curvature radius on a rear side of an inlet 10*a* of a discharge conduit 10, which smoothens flow of flush water flowing outward from the well portion 22 to the discharge conduit 10.

Next, a state of flow of flush water will be described with reference to FIGS. 13 and 14.

Figure 13:
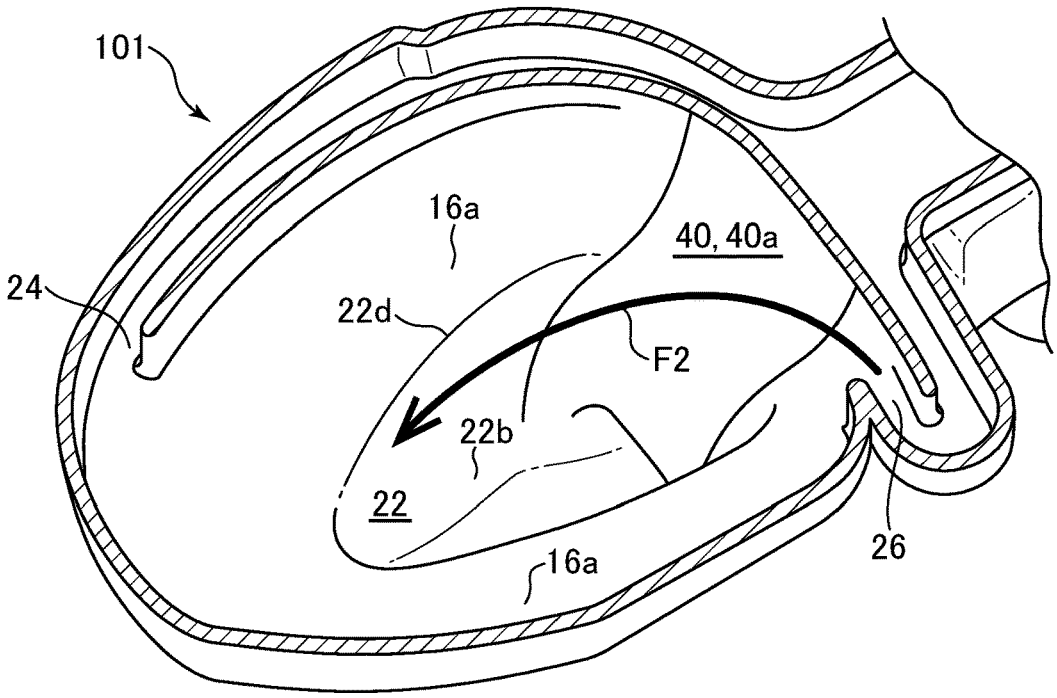
FIG. 13 is a perspective cross-sectional view showing a state of flow of a rearward main flow of flush water spouted from a spouting port in the flush toilet according to the second embodiment of the present invention.

First, as shown in FIG. 13, a rearward main flow F2 of the flush water spouted from a second spouting port 26 passes through the rear surface 40 of the waste receiving surface 16, but at this time, due to the concave portion 40*a*, flush water does not continuously circulate over the waste receiving surface 16, flows along the left side surface 22*b* of the well portion 22 and substantially flows into (flows down to) the fourth region S4 and the third region S3 of the pooled water surface 20 described above.

Figure 14:
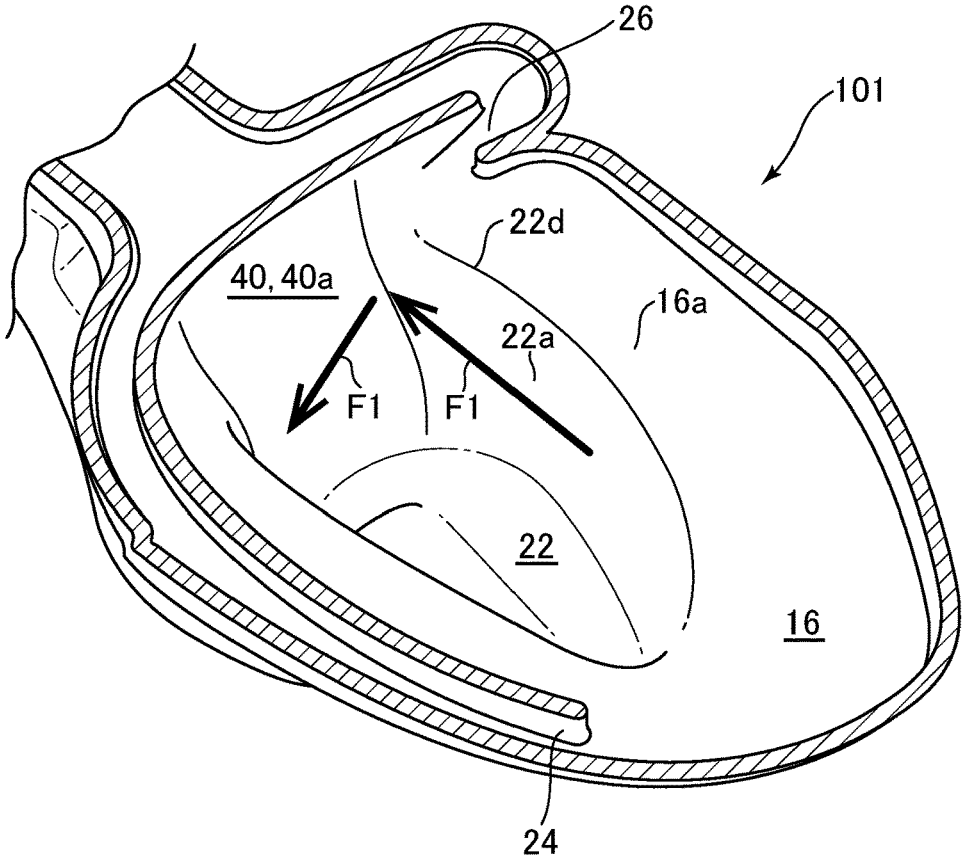
FIG. 14 is a perspective cross-sectional view showing a state of flow of a forward main flow of flush water spouted from the spouting port in the flush toilet according to the second embodiment of the present invention.

Next, as shown in FIG. 14, a forward main flow F1 of the flush water spouted from a first spouting port 24 flows from the waste receiving surface 16 along the right side surface 22*a* of the well portion 22, and then collides with the concave portion 40*a* of the rear surface 40 of the waste receiving surface 16. A flow direction of the forward main flow F1 is subjected to vector conversion from a front-rear direction to a lateral direction, and the forward main flow F1 flows into (flows down to) the second region S2 and the first region S1 of the pooled water surface 20 described above.

Hereinafter, operations and effects of the flush toilet according to the second embodiment of the present invention described above will be described.

First, in the flush toilet 101 according to the present embodiment, the rear surface 40 of the waste receiving surface 16 of the bowl 6 includes the concave portion 40*a* recessed deeper than the left and right side surfaces 16*a* of the waste receiving surface 16, and the rear surface 40 extends to below the upper end 22*c* of the left and right side surfaces 22*a* and 22*b* of the well portion 22. Therefore, the forward main flow F1 of flush water passes through the side surface of the well portion 22 to reach the rear surface 40 of the waste receiving surface 16 and changes the flow direction on the rear surface 40 to flow as it is along the rear surface 40 of the waste receiving surface 16 into the pooled water surface 20. As a result, according to the present embodiment, the forward main flow F1 of flush water can be guided to the pooled water surface 20 earlier than a flow circulating around the waste receiving surface 16 and flowing into the pooled water surface 20, and hence the forward main flow F1 and the rearward main flow F2 can be guided to the pooled water surface 20 at about the same timing. This can improve the floating waste discharge performance.

Next, as in the above described flush toilet in Japanese Patent Laid-Open No. 2017-179958, if a rear concave portion of the waste receiving surface of the bowl is wider than the lateral width of the well portion, the flush water circulating around the side surface of the well portion from the front might spreads, and the inflow into the pooled water surface might delay. On the other hand, in the flush toilet 101 according to the present embodiment, since the concave portion 40*a* on the rear surface 40 of the waste receiving surface 16 of the bowl 6 is formed so that the lateral width W2 of the concave portion is smaller than the maximum lateral width W1 of the well portion 22, the flush water circulating around the side surface of the well portion 22 from the front can be inhibited from spreading, and the inflow of the forward main flow F1 of flush water into the pooled water surface 20 can be speeded up.

Next, in the flush toilet 101 according to the present embodiment, the concave portion 40*a* on the rear surface 40 of the waste receiving surface 16 of the bowl 6 is formed in the concave shape along the up-down direction and has the lower end connected to the rear surface 22*d* of the well portion 22 by the convex-shaped connecting portion 42, and hence flush water can be smoothly guided to the pooled water surface 20.

Next, in the flush toilet 101 according to the present embodiment, the well portion is formed so that, in the curvature radius R1 at the upper position of the rear surface 22*d* of the well portion 22 and the curvature radius R2 at the lower position, the curvature radius R2 at the lower position is smaller than the curvature radius R1 at the upper position (R1>R2), which smoothens the flow of flush water flowing outward from the well portion 22 to the discharge conduit 10, and improves a waste discharge performance.

Next, with reference to FIGS. 15, 16, 17A and 17B, a flush toilet 201 according to a third embodiment of the present invention will be described.

Figure 15:
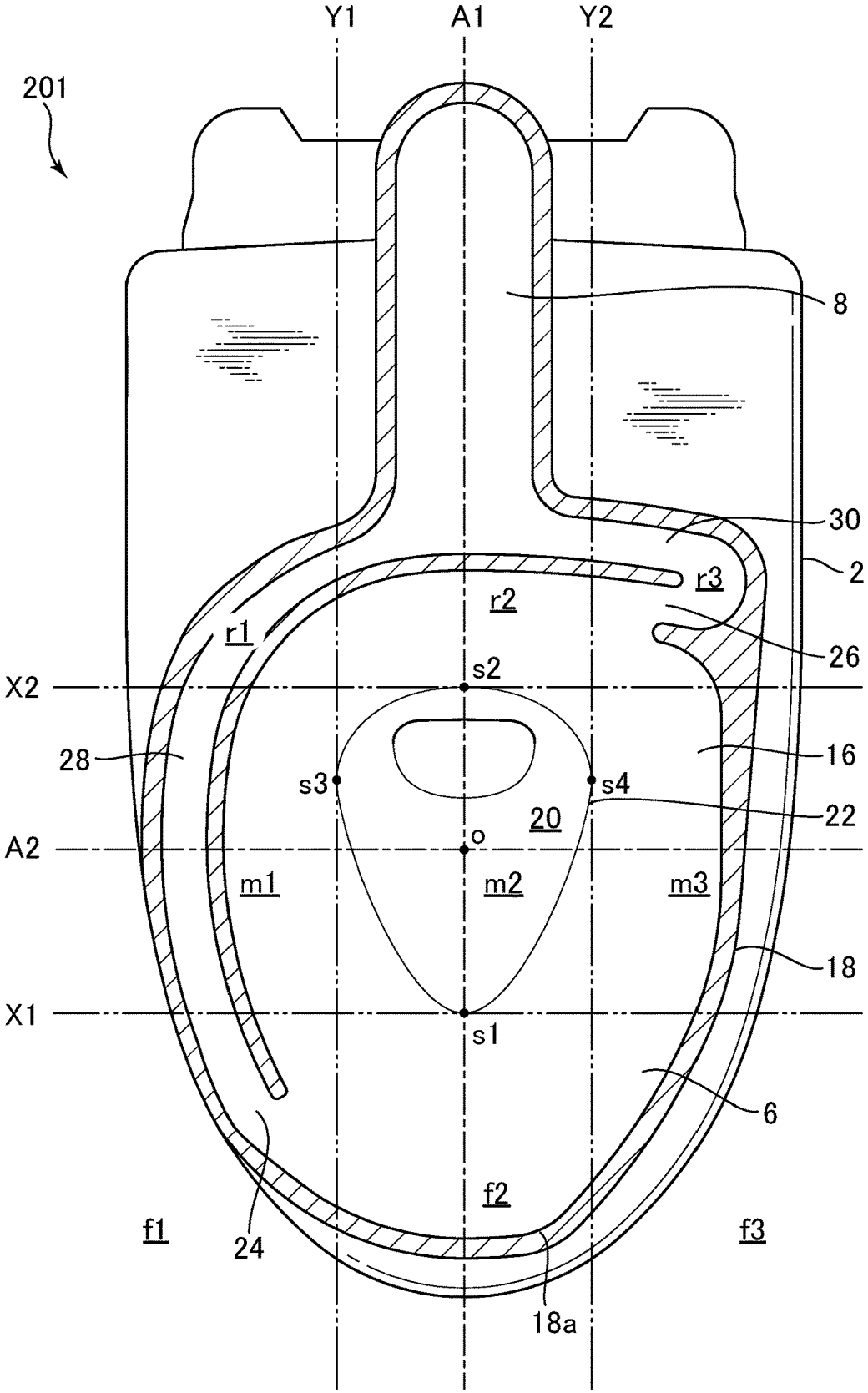
FIG. 15 is a planar cross-sectional view of a flush toilet according to a third embodiment of the present invention.

First, a position of a spouting port (rim spouting port) of a bowl in the flush toilet according to the third embodiment will be described in detail with reference to FIG. 15. FIG. 15 is a planar cross-sectional view of the flush toilet according to the present embodiment. In this third embodiment, the above-described first spouting port 24 and second spouting port 26 will be described as a first rim spouting port 24 and a second rim spouting port 26 for convenience.

As shown in FIG. 15, a plane of the bowl 6 is divided into nine regions to explain the position of the rim spouting port in the flush toilet 201 according to the present embodiment. The plane of the bowl 6 is divided into nine regions (f1 to f3, m1 to m3, r1 to r3) by an extension line X1 extending in a left-right direction at a front end s1 of a pooled water surface 20, an extension line X2 extending in the left-right direction at a rear end s2 of the pooled water surface 20, an extension line Y1 extending in a front-rear direction at a left end s3 of the pooled water surface 20 and an extension line Y2 extending in the front-rear direction at a right end s4 of the pooled water surface 20.

Specifically, the plane of the bowl 6 is divided into a front region (f1 to f3) located in front of the front end s1 of the pooled water surface 20, a lateral region (m1 to m3) located between the front end s1 and the rear end s2 of the pooled water surface 20 and a rear region (r1 to r3) located behind the rear end s2 of the pooled water surface 20. Further, the front region is divided into a left front region f1 located on the left side of the left end s3 of the pooled water surface 20, an intermediate front region f2 located between the left end s3 and the right end s4 of the pooled water surface 20 and a right front region f3 located on the right side of the right end s4 of the pooled water surface 20. Similarly, the lateral region is divided from the left into a left lateral region m1, an intermediate lateral region m2 and a right lateral region m3, and the rear region is divided from the left into a left rear region r1, an intermediate rear region r2 and a right rear region r3.

In the present embodiment, the pooled water surface 20 is formed in the intermediate lateral region m2 located in the center of the bowl 6. The first rim spouting port 24 is disposed in the left front region f1 in front of the front end s1 of the pooled water surface 20 (extension line X1) and on the left side of the left end s3 of the pooled water surface 20 (extension line Y1). Further, the first rim spouting port 24 is disposed upstream from a tip of the bowl 6, which has a minimum curvature radius in a planar view of the bowl 6.

The second rim spouting port 26 is disposed in the right rear region r3 behind the rear end s2 of the pooled water surface 20 (extension line X2) and on the right side of the right end s4 of the pooled water surface 20 (extension line Y2). Further, the second rim spouting port 26 is disposed near the rear end of the bowl 6.

The first rim spouting port 24 and the second rim spouting port 26 are arranged in the left front region f1 and the right rear region r3, respectively, that are diagonal so as to sandwich an intersection point O at which a centerline X that divides the pooled water surface 20 into two equal parts in a front-rear direction and a centerline Y that divides the pooled water surface 20 into two equal parts in the left-right direction intersect.

In the present embodiment, the first rim spouting port 24 is disposed in the left front region f1, and the second rim spouting port 26 is disposed in the right rear region r3. Alternatively, the first rim spouting port 24 may be disposed in the right front region f3, and the second rim spouting port 26 may be disposed in the left rear region r1.

Figure 16:
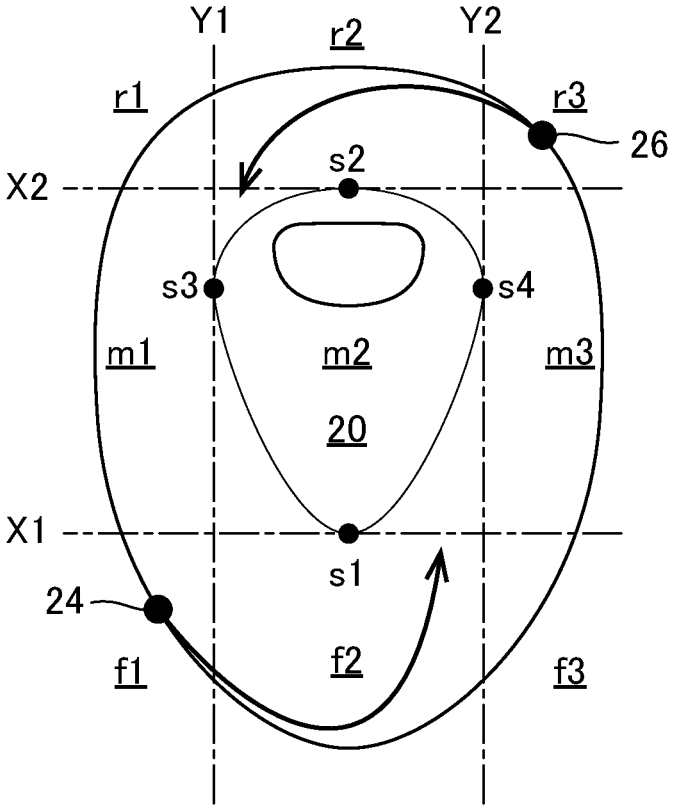
FIG. 16 is a conceptual plan view showing the position of a spouting port (rim spouting port) and the flow of flush water in the flush toilet according to the third embodiment of the present invention.
Figure 17A:
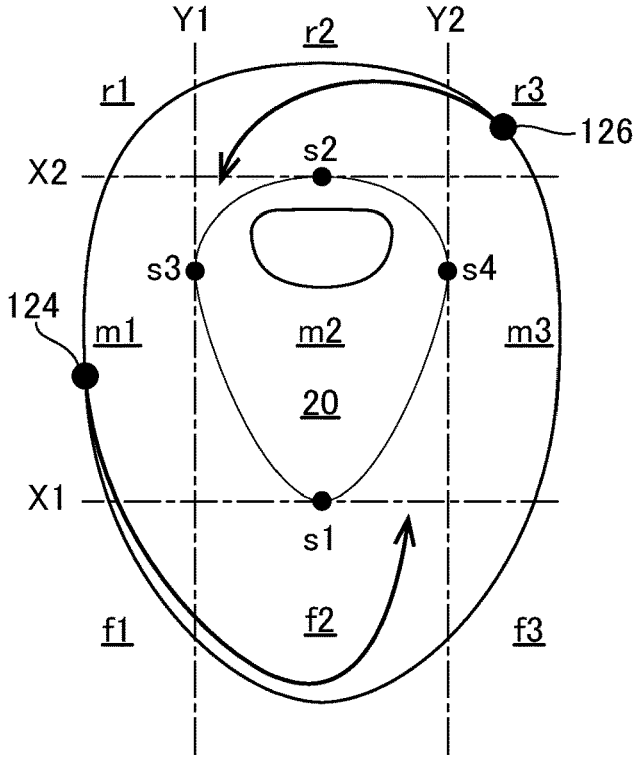
FIG. 17A is a conceptual plan view showing the position of a spouting port (rim spouting port) and the flow of flush water in a flush toilet according to Conventional Example 1.
Figure 17B:
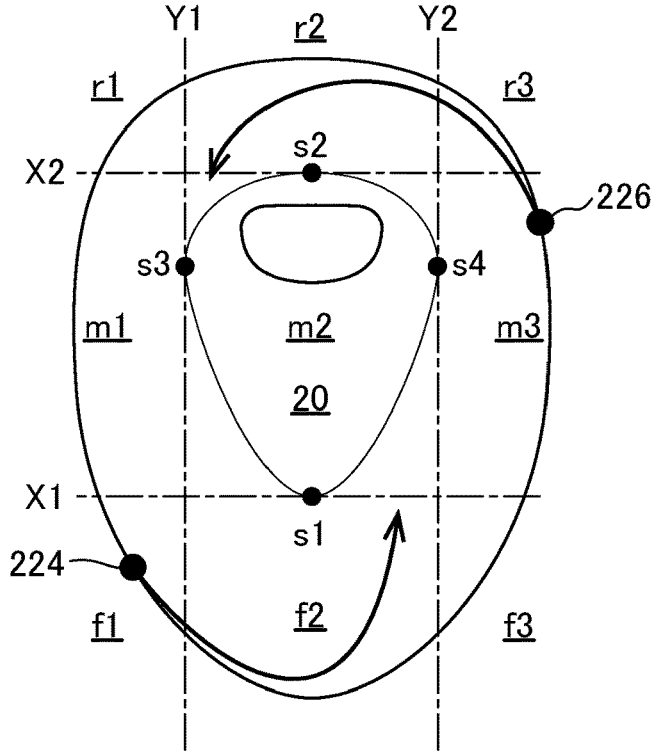
FIG. 17B is a conceptual plan view showing the position of a spouting port (rim spouting port) and the flow of flush water in a flush toilet according to Conventional Example 2.

Next, with reference to FIGS. 16, 17A and 17B, the flow of flush water in the flush toilet according to the present embodiment will be described while comparing with Conventional Examples 1 and 2.

As for the first rim spouting port, in Conventional Example 1 (see FIG. 17A), a first rim spouting port 124 is disposed in a left lateral region m1 between a front end s1 and a rear end s2 of a pooled water surface 20. Therefore, the flush water spouted forward from the first rim spouting port 124 cannot flow into the pooled water surface 20 in the left lateral region m1 and passes through the left lateral region m1 to flow through front regions (f1 to f3) and then flows into the pooled water surface 20 from a front side (see arrows in FIG. 17A). On the other hand, in the present embodiment (see FIG. 16), since the first rim spouting port 24 is disposed in the left front region f1 in front of the front end s1 of the pooled water surface 20, the flush water spouted forward from the first rim spouting port 24 flows through the front regions (f1 to f3) and can flow into the pooled water surface 20 from the front side without passing through the other regions (see arrows in FIG. 16).

As for the second rim spouting port, in Conventional Example 2 (see FIG. 17B), a second rim spouting port 226 is disposed in a right lateral region m3 between a front end s1 and a rear end s2 of a pooled water surface 20. Therefore, the flush water spouted rearward from the second rim spouting port 226 cannot flow into the pooled water surface 20 in the right lateral region m3 and passes through the right lateral region m3 to flow through rear regions (r1 to r3) and then flows into the pooled water surface 20 from a rear side (see arrows in FIG. 17B). On the other hand, in the present embodiment (see FIG. 16), since the second rim spouting port 26 is disposed in the right rear region r3 behind the rear end s2 of the pooled water surface 20, the flush water spouted rearward from the second rim spouting port 26 flows through the rear regions (r1 to r3) and can flow into the pooled water surface 20 from the rear side without passing through the other regions (see arrows in FIG. 16).

In the present embodiment (see FIG. 16), the first rim spouting port 24 is disposed in the left front region f1 in front of the front end s1 of the pooled water surface 20, and the second rim spouting port 26 is disposed in the right rear region r3 behind the rear end s2 of the pooled water surface 20. Therefore, at the start of flushing, the flush water spouted forward from the first rim spouting port 24 and the flush water spouted rearward from the second rim spouting port 26 earlier and almost simultaneously flow into the pooled water surface 20 as compared to the conventional examples (see arrows in FIG. 16).

Next, operations and effects according to the flush toilet 201 of the third embodiment of the present invention described above will be described.

In the flush toilet 201 according to the present embodiment, the first rim spouting port 24 is disposed in front of the front end s1 of the pooled water surface 20 in an inner space of the bowl 6, and flush water is spouted forward from the first rim spouting port 24, and the second rim spouting port 26 is disposed behind the rear end s2 of the pooled water surface 20 in the bowl 6, and flush water is spouted rearward from the second rim spouting port 26. Therefore, at the start of flushing, flush water from the first rim spouting port 24 and the second rim spouting port 26 is allowed to flow into pooled water earlier and almost simultaneously, and the flush water can be evenly poured into the whole pooled water surface 20. Therefore, in the flush toilet in which all the flush water supplied to a toilet main body 2 is spouted from the rim spouting port, floating waste can be sufficiently discharged.

Further, in the flush toilet 201 according to the present embodiment, preferably, the first rim spouting port 24 and the second rim spouting port 26 are arranged on the left side of the left end s3 of the pooled water surface 20 or on the right side of the right end s4 of the pooled water surface 20. Therefore, at the start of flushing, flush water from the first rim spouting port 24 and the second rim spouting port 26 can flow into the pooled water more simultaneously, and the flush water can be evenly poured into the whole pooled water surface 20.

In the flush toilet 201 according to the present embodiment, preferably the first rim spouting port 24 and the second rim spouting port 26, in a planar view, are arranged in regions, respectively, that are diagonal so as to sandwich the intersection point O at which the centerline X that divides the pooled water surface 20 into two equal parts in the front-rear direction and the centerline Y that divides the pooled water surface 20 into two equal parts in the left-right direction intersect. Therefore, at the start of flushing, the flush water from the first rim spouting port 24 and the second rim spouting port 26 flows into the pooled water more simultaneously and the flush water can be evenly poured into the whole pooled water surface 20.

In the present embodiment, the flush toilet including two rim spouting ports has been described, but the present invention is not limited thereto, and may be applied to a flush toilet including three or more rim spouting ports. In this case, three or more rim spouting ports may be distributed and arranged in any one of the left front region f1, the right front region f3, the left rear region r1 or the right rear region r3 described above.

Next, supplementary description of the flush toilet according to the above-described present embodiments will be made. In the flush toilets 1, 101 and 201 according to the present embodiments, as described above, the bowl 6 is provided with the well portion 22 that forms the pooled water surface 20 inside. The well portion 22 has the substantially triangular shape in a planar view. The well portion 22 is formed so that the height of the upper end 22*c* of each of the right side surface 22*a* and the left side surface 22*b* decreases toward the front as shown in FIGS. 8 and 9. Therefore, the rearward main flow F2 flows along the left side surface 22*b* at the upper end 22*c* at which the height of the left side surface 22*b* is substantially constant, and the flow along the upper end 22*c* diverges at a change point of the upper end 22*c* in an inclined portion that lowers toward the front of the upper end 22C. The flow changes in a direction to flow from the left side surface 22*b* into the pooled water surface 20, and the rearward main flow F2 circulates around the side surface of the well portion 22 and can function as inflow promoting means to suppress the delay in inflow into the pooled water surface 20. Since the upper end 22*c* of the right side surface 22*a* is formed to rise rearward from the front, the forward main flow F1 flows along the right side surface 22*a*. In an inclined portion that rises toward the rear of the upper end 22*c*, the flow along the upper end 22*c* is likely to change in a direction to flow from the right side surface 22*a* into the pooled water surface 20. The forward main flow F1 circulates around the side surface of well portion 22 and can function as inflow promoting means to suppress the delay in inflow into the pooled water surface 20.

In addition, since the height of the upper end 22*c* of each of both side surfaces 22*a* and 22*b* of the well portion 22 decreases toward the front, the rearward main flow F2 flowing downward from behind the well portion 22 to the well portion 22 and flowing along the left side surface 22*b* flows into the pooled water surface 20, then abuts on the front of the well portion 22 and rises. At this time, the forward main flow F1 flows from the front region of the waste receiving surface 16 of the bowl 6 toward the well portion 22, and the rearward main flow F2 and the forward main flow F1 join each other in front of the well portion 22. As a result, a strong push-in flow is formed and a waste discharge performance improves.

What is claimed is:

1. A flush toilet that is flushed with flush water to discharge waste, the flush toilet comprising:

a bowl including:

a waste receiving surface that receives waste, a rim formed on an upper part of the waste receiving surface and a well portion that is formed below the waste receiving surface and in which a pooled water surface is formed;

a first spouting port and a second spouting port that spout flush water along the rim, wherein the first spouting port forms a forward main flow and the second spouting port forms a rearward main flow, the first spouting port is disposed on one of left and right sides of a front region of the waste receiving surface of a bowl surface, the second spouting port is disposed on the other of the left and right sides of a rear region of the waste receiving surface of the bowl surface; and a discharge conduit connected to a bottom portion of the bowl, wherein the first spouting port is disposed in front of a front end of the pooled water surface and the second spouting port is disposed behind a rear end of the pooled water surface;

wherein the forward main flow and the rearward main flow circulate around the waste receiving surface of the bowl and flow, in the beginning of flushing start which is an initial flushing period among three divided periods from a start of flush water flowing into the pooled water surface to an end of the flush water flowing into the pooled water surface, into three or more regions of the pooled water surface divided into four regions by a front-rear centerline and a left-right centerline that divide the pooled water surface into two parts in a front-rear direction and a left-right direction in a planar view; and wherein a predetermined energy accumulated amount of flush water flowing into the pooled water surface reaches, within one second, three or more regions of the pooled water surface divided into four regions.

2. The flush toilet according to claim 1, wherein the forward main flow and the rearward main flow of flush water flow into the pooled water surface without joining each other.

3. The flush toilet according to claim 1, wherein the forward main flow and the rearward main flow of flush water flow into different regions of a region divided into four regions, respectively.

4. The flush toilet according to claim 1, wherein the forward main flow mainly flows into the rear region on one of the left and right sides on which the first spouting port is not provided in the pooled water surface divided into four regions, and the rearward main flow mainly flows into the front region on one of the left and right sides on which the second spouting port is not provided in the pooled water surface divided into four regions.

5. The flush toilet according to claim 1, wherein a rear surface of the waste receiving surface of the bowl comprises a concave portion recessed deeper than left and right side surfaces of the waste receiving surface, and the rear surface extends to below an upper end of left and right side surfaces of the well portion.

6. The flush toilet according to claim 5, wherein the concave portion on the rear surface of the waste receiving surface of the bowl is formed so that a lateral width of the concave portion is smaller than a maximum lateral width of the well portion.

7. The flush toilet according to claim 5, wherein the concave portion on the rear surface of the waste receiving surface of the bowl is formed in a concave shape along an up-down direction and has a lower end connected to a rear surface of the well portion by a convex-shaped connecting portion.

8. The flush toilet according to claim 5, wherein the well portion is formed so that, in a curvature radius R1 at an upper position of a rear surface of the well portion and a curvature radius R2 at a lower position, the curvature radius R2 at the lower position is smaller than the curvature radius R1 at the upper position.

9. The flush toilet according to claim 1, wherein the first rim spouting port and the second rim spouting port are arranged on a left side of a left end of the pooled water surface or on a right side of a right end of the pooled water surface.

10. The flush toilet according to claim 1, wherein the first rim spouting port and the second rim spouting port, in a planar view, are arranged in regions, respectively, that are diagonal so as to sandwich an intersection point at which a centerline that divides the pooled water surface into two equal parts in a left-right direction and a centerline that divides the pooled water surface into two equal parts in a front-rear direction intersect.

* * * * *